US006982373B1

(12) United States Patent
Yu

(10) Patent No.: US 6,982,373 B1
(45) Date of Patent: Jan. 3, 2006

(54) MUSICAL INSTRUMENT STAND

(76) Inventor: Ming - Ti Yu, 122-5, Jun Laio Rd., Feng Yuan, Taichung Hsien (TW)

( * ) Notice: Subject to any disclaimer, the term of this patent is extended or adjusted under 35 U.S.C. 154(b) by 0 days.

(21) Appl. No.: 10/934,124

(22) Filed: Sep. 7, 2004

(51) Int. Cl.
*G10D 3/00* (2006.01)

(52) U.S. Cl. ..... 84/327; 84/329; 248/443

(58) Field of Classification Search ..... 84/290, 84/327, 329; 248/443, 682, 121, 127, 200
See application file for complete search history.

(56) References Cited

U.S. PATENT DOCUMENTS 5,772,981 A * 6/1998 Govindan et al. ..... 424/1.49
6,091,008 A * 7/2000 Yu ..... 84/327
6,576,822 B1 * 6/2003 Grace ..... 84/327

* cited by examiner

*Primary Examiner*—Kimberly Lockett
(74) *Attorney, Agent, or Firm*—Alan D. Kamrath; Nikolai & Mersereau, P.A.

(57) ABSTRACT

A musical instrument stand has a tripod device, a main shaft disposed on the tripod device, a holder device disposed on the main shaft, at least a retainer device, and at least a bracket device. The retainer device is disposed on the main shaft. The bracket device engages with the retainer device. The tripod device has a joint, and three legs connected to the joint. The main shaft has a first tube engaging with the joint, and a second tube inserted through the first tube. The holder device has a main seat, a connector connected to the main seat, a fixed fastening device, a movable fastening device, and the connector engaging with the main shaft. The main seat has a generally U-shaped pad, an aperture engaging with the fixed fastening device, and a socket portion engaging with the movable fastening device.

7 Claims, 10 Drawing Sheets

MUSICAL INSTRUMENT STAND

FIELD OF THE INVENTION

The present invention relates to a musical instrument stand, and more particularly to a musical instrument stand which holds a musical instrument stably.

BACKGROUND OF THE INVENTION

Referring to FIGS. 1 and 2, a conventional musical instrument stand has a tripod device 11, a main shaft 12 disposed on the tripod device 11, a brace device 13 disposed on the main shaft 12, and two brackets 113. The tripod device 11 has a main leg 111 and two auxiliary legs 112. Each of the brackets 113 is connected to the corresponding auxiliary let 112. The main shaft 12 has a L shape. The brace device 13 has a U-shaped bracer 131 having two arms 134, an end rod 133 disposed on one of the arms 134, and a locking bar 132. The locking bar 132 has an end groove 136, and an end hole 135 to receive the end rod 133. One end of the U-shaped bracer 131 has the end rod 133 engaging with the end hole 135, and the other end of the U-shaped bracer 131 engages with the end groove 136. The locking bar 132 is rotated along a direction A. Then a guitar 14 is placed on the conventional musical instrument stand. The brackets 113 and the brace device 13 support the guitar 14. Since the U-shaped bracer 131 is made of a plastics material, the end hole 135 of the locking bar 132 will be enlarged after a long period of usage. Therefore, the end rod 135 will be disengaged from the end hole 135 of the locking bar 132 easily.

SUMMARY OF THE INVENTION

An object of the present invention is to provide a musical instrument stand which holds a musical instrument stably.

Accordingly, a musical instrument stand comprises a tripod device, a main shaft disposed on the tripod device, a holder device disposed on the main shaft, at least a retainer device, and at least a bracket device. The retainer device is disposed on the main shaft. The bracket device engages with the retainer device. The tripod device has a joint, and three legs connected to the joint. The main shaft has a first tube engaging with the joint, and a second tube inserted through the first tube. The holder device has a main seat, a connector connected to the main seat, a fixed fastening device, a movable fastening device, and the connector engaging with the main shaft. The main seat has a generally U-shaped pad, an aperture engaging with the fixed fastening device, and a socket portion engaging with the movable fastening device.

In accordance with a preferred embodiment of the present invention, a musical instrument stand comprises a tripod device, a main shaft disposed on the tripod device, a holder device disposed on the main shaft, at least a retainer device, and at least a bracket device. The retainer device is disposed on the main shaft. The bracket device engages with the retainer device. The tripod device has a joint, and three legs connected to the joint. The main shaft has a first tube engaging with the joint, and a second tube inserted through the first tube. The holder device has a main seat, a connector connected to the main seat, a fixed fastening device, a movable fastening device, and the connector engaging with the main shaft. The main seat has a generally U-shaped pad, an aperture engaging with the fixed fastening device, and a socket portion engaging with the movable fastening device. The fixed fastening device has a rod, a first hose, and a cap plug. The rod is inserted through the aperture of the main seat. The first hose encloses the rod. The cap plug engages with the rod. The movable fastening device has a locking bar, a second hose, and a pillar having an annular protrusion and an end protrusion. The pillar is inserted through the second hose and inserted in the socket portion of the main seat. The locking bar engages with the pillar. The locking bar has a fastening end having an end chamber to receive the fixed fastening device. The connector has a top wall, a peripheral wall, a through hole formed on the peripheral wall, an inner chamber communicating with the through hole, and a confining portion communicating with the inner chamber. A nut is inserted in the inner chamber to match the through hole of the connector. The nut is blocked by the confining portion of the connector. A threaded button is inserted through the through hole of the connector to be engaged with the nut. The socket portion of the main seat has a first end, a second end, a first chamber, a second chamber communicating with the first chamber, a periphery wall surrounding the first chamber and the second chamber, a confining groove to receive the end protrusion of the pillar, and a confining block disposed in the second chamber to block the end protrusion of the pillar. A diameter of the first chamber is smaller than a diameter of the second chamber. The retainer device has a pipe and a hollow plug engaging with the pipe. The pipe has a distal end, a proximal end, and a round hole. The hollow plug has a click portion and a confining recess. The bracket device has a generally U-shaped frame and a post having an end block to be inserted in the confining recess of the hollow plug. The post is inserted in the hollow plug.

DETAILED DESCRIPTION OF THE INVENTION

Figure 1:
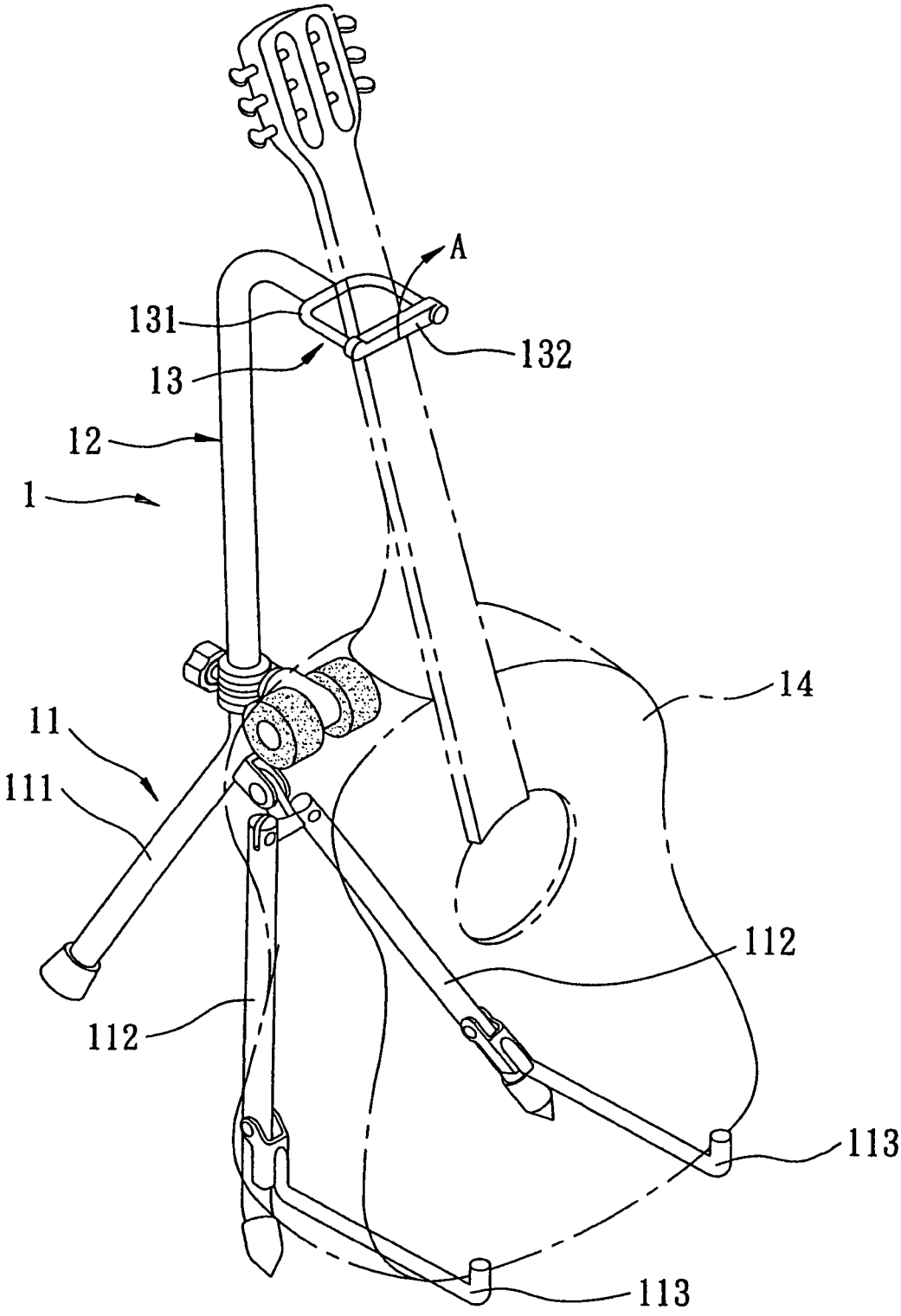
F I G. 1 PRIOR ART
FIG. 1 is a perspective view of a conventional musical instrument stand of the prior art.
Figure 2:
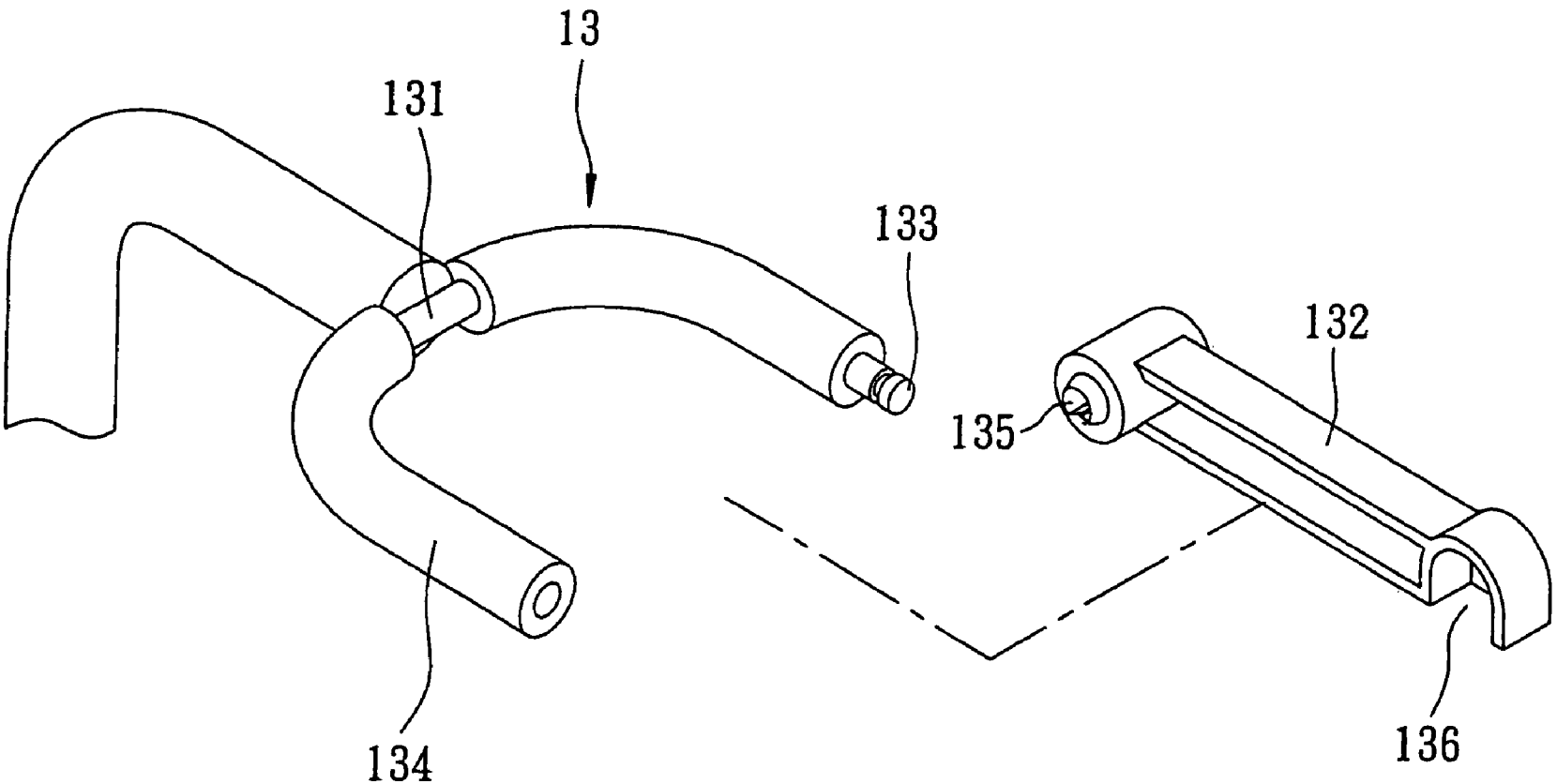
FIG. 2 PRIOR ART
FIG. 2 is a perspective exploded view of a brace device stand of the prior art.
Figure 3:
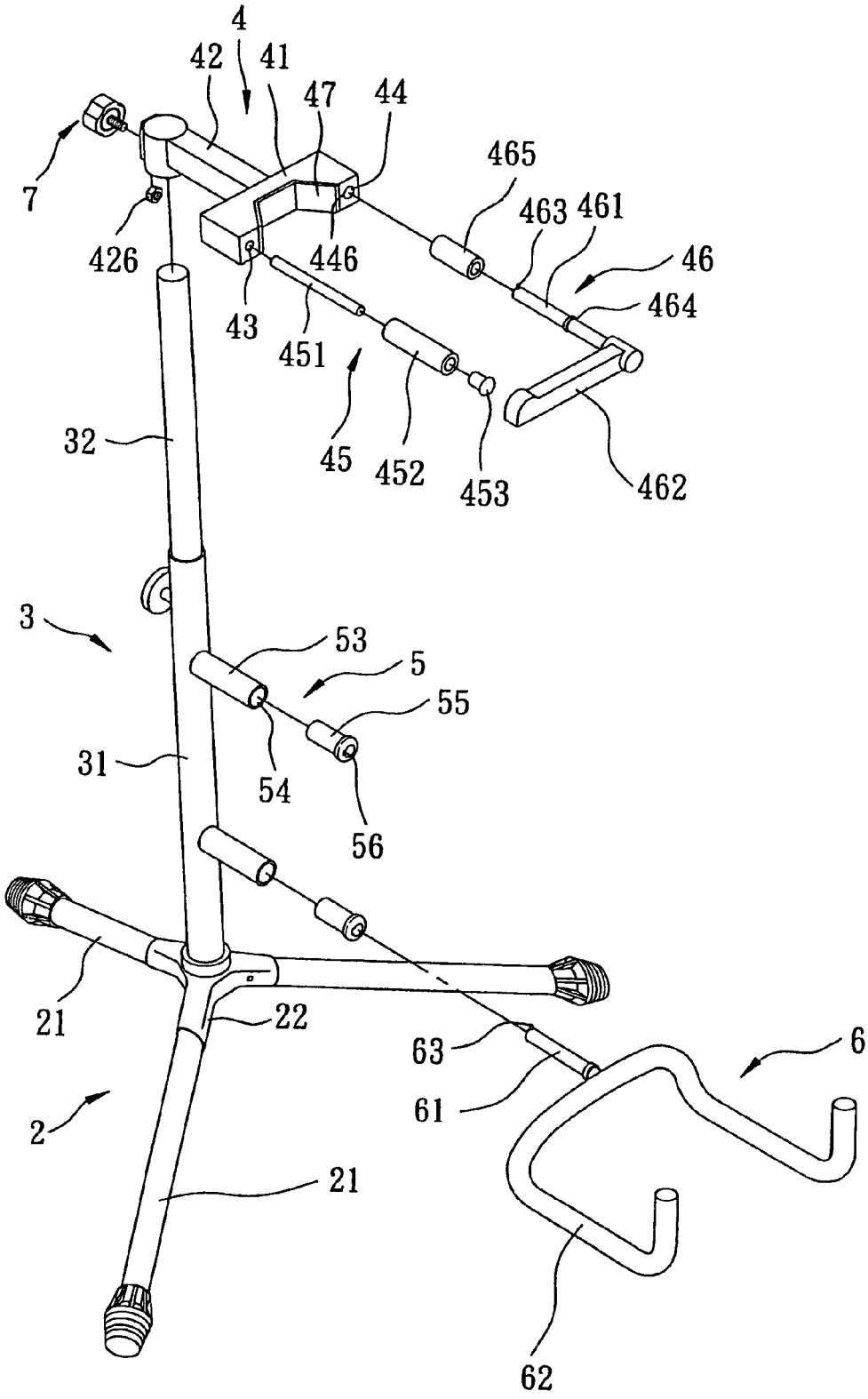
FIG. 3 is a perspective exploded view of a musical instrument stand of a first preferred embodiment in accordance with the present invention.
Figure 4:
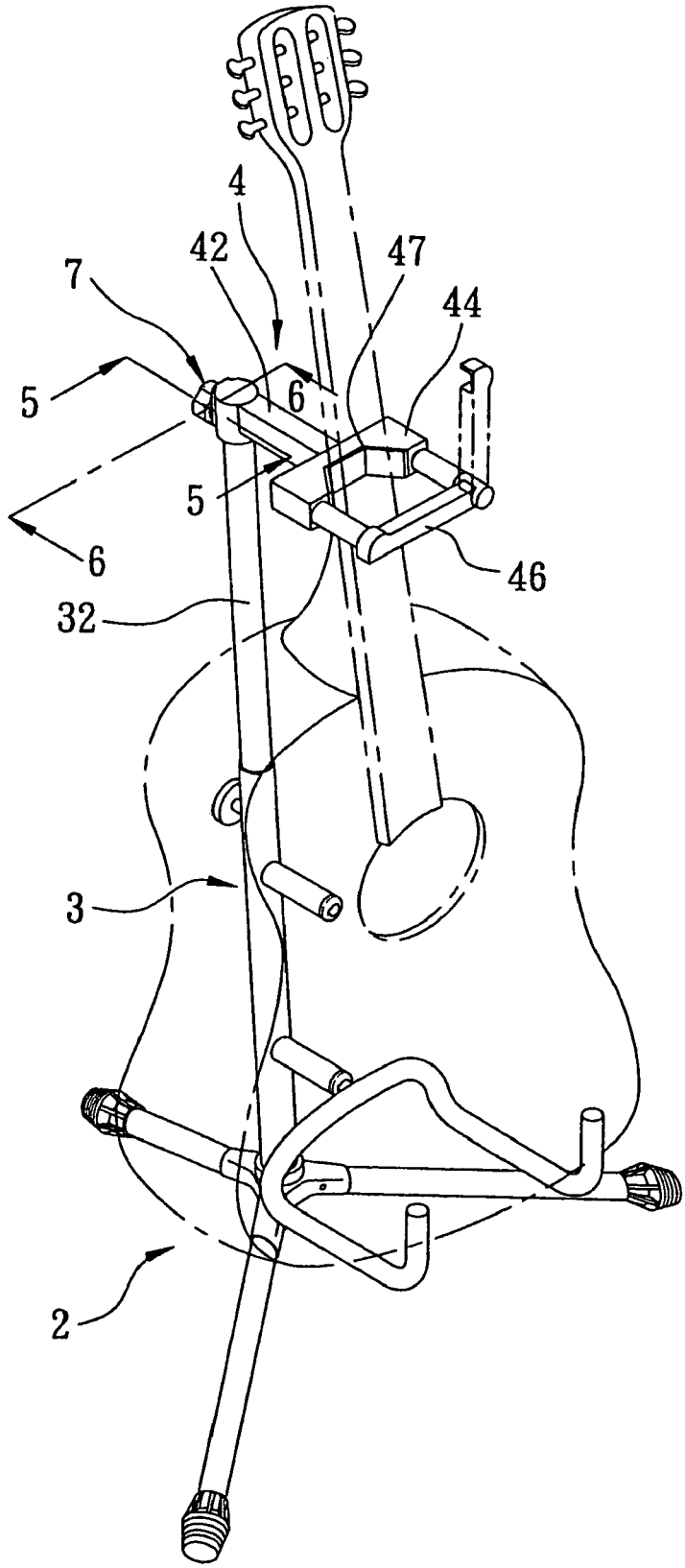
FIG. 4 is a perspective assembly view of a musical instrument stand of a first preferred embodiment in accordance with the present invention.
Figure 5:
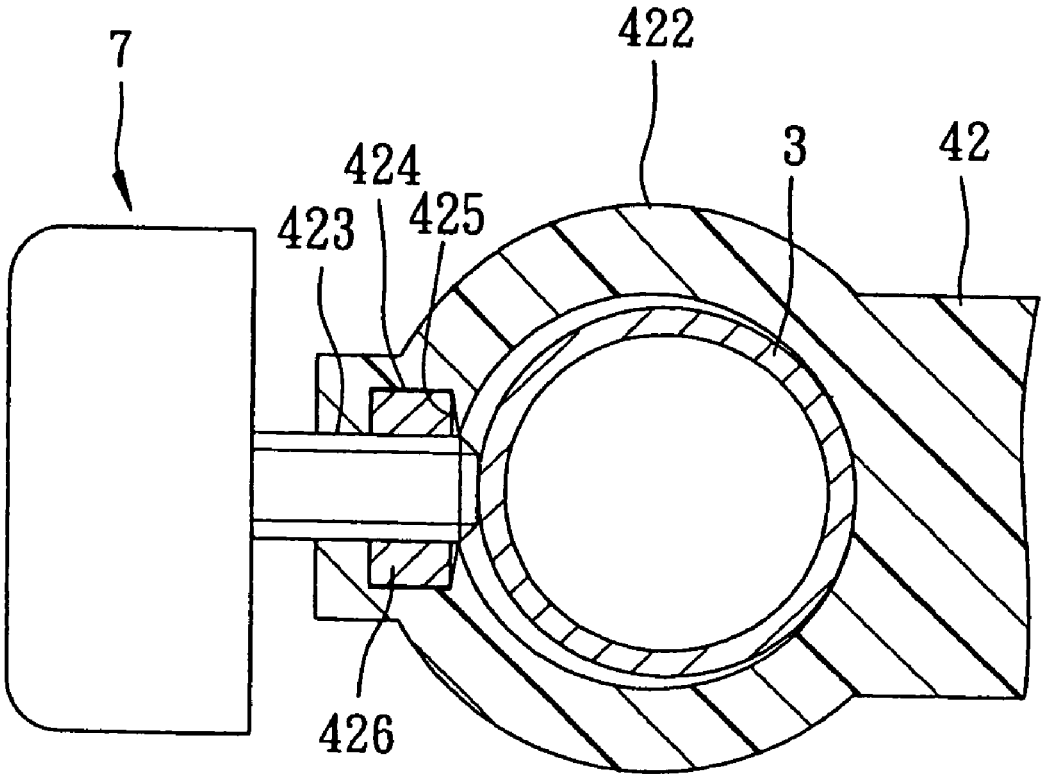
FIG. 5 is a sectional view taken along line 5—5 in FIG. 4.
Figure 6:
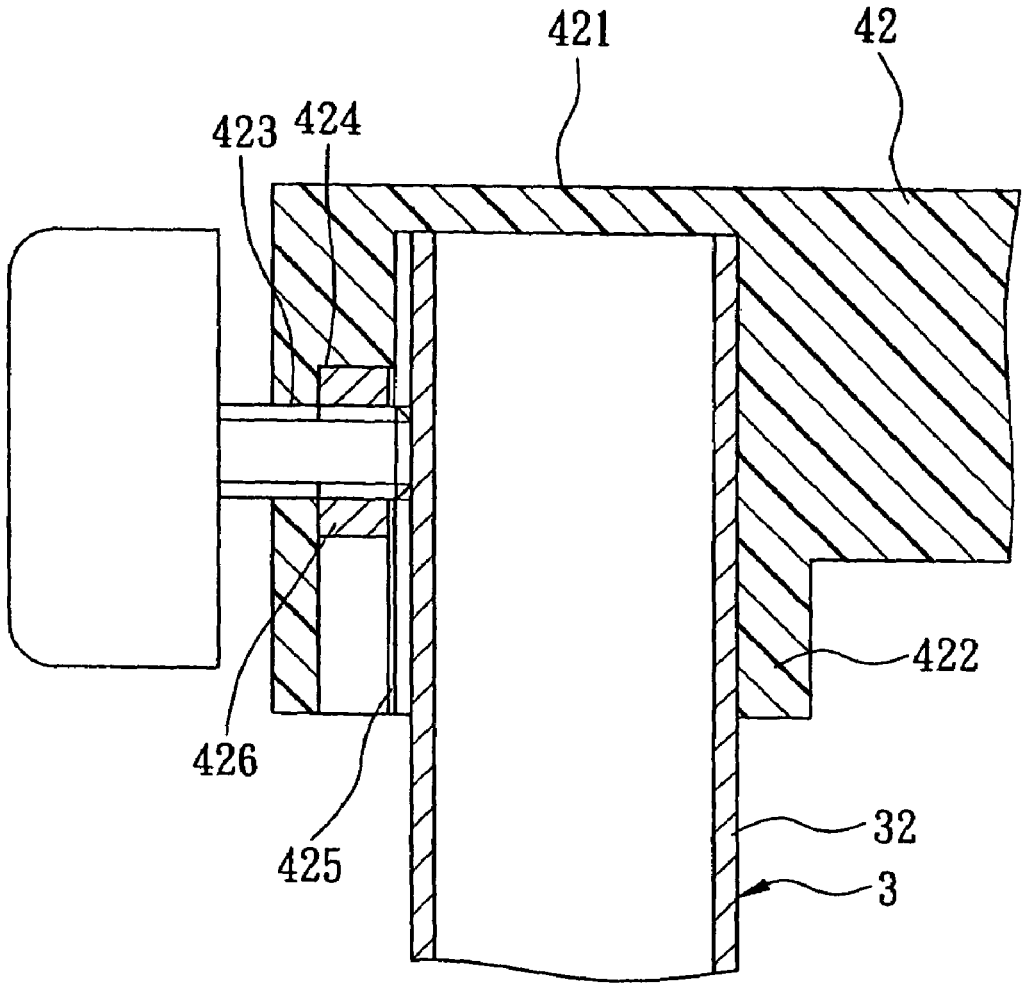
FIG. 6 is a sectional view taken along line 6—6 in FIG. 4.
Figure 7:
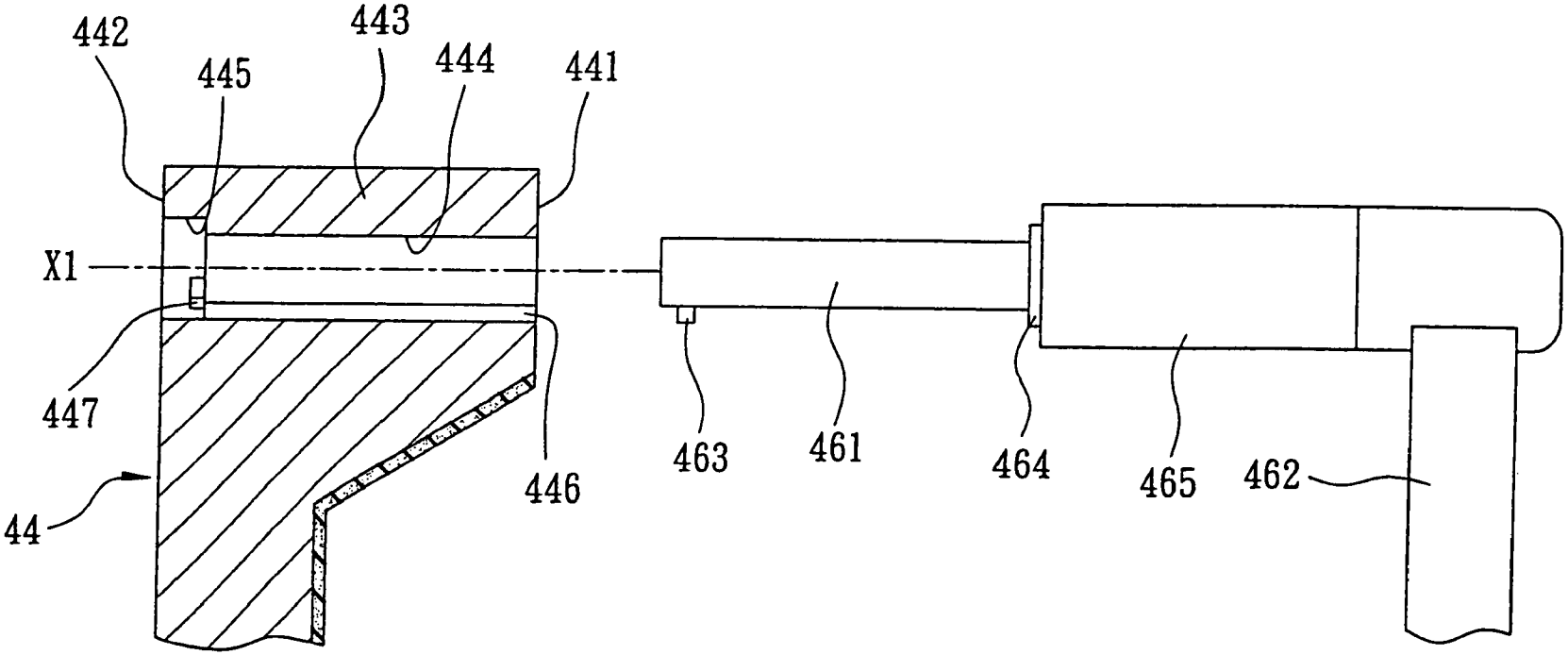
FIG. 7 is a sectional schematic view illustrating an engagement between a movable device and a socket portion of a holder device of a first preferred embodiment in accordance with the present invention.
Figure 8:
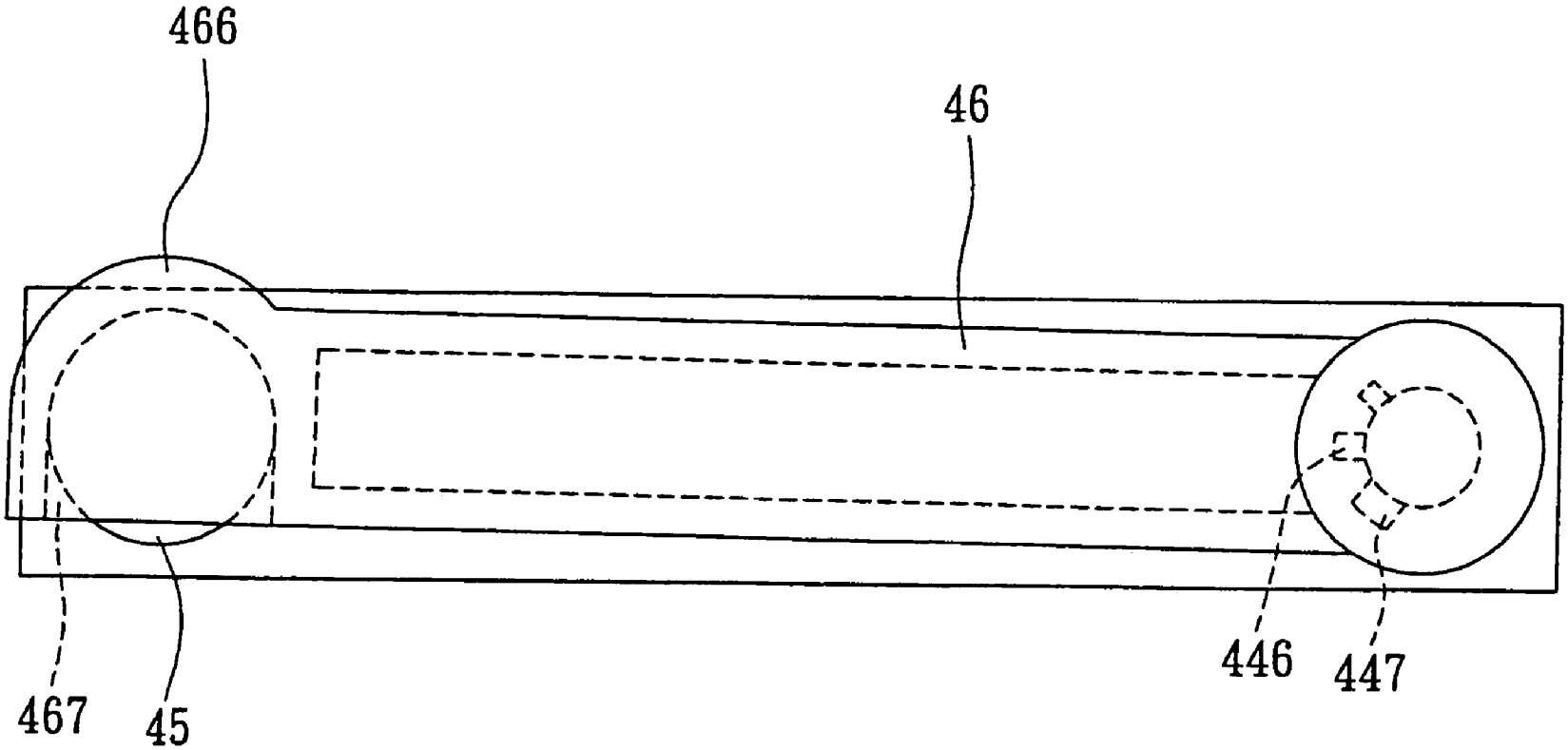
FIG. 8 is a sectional schematic view illustrating a locking bar engaging with a cap plug and a confining groove engaging with a confining block of a first preferred embodiment in accordance with the present invention.
Figure 9:
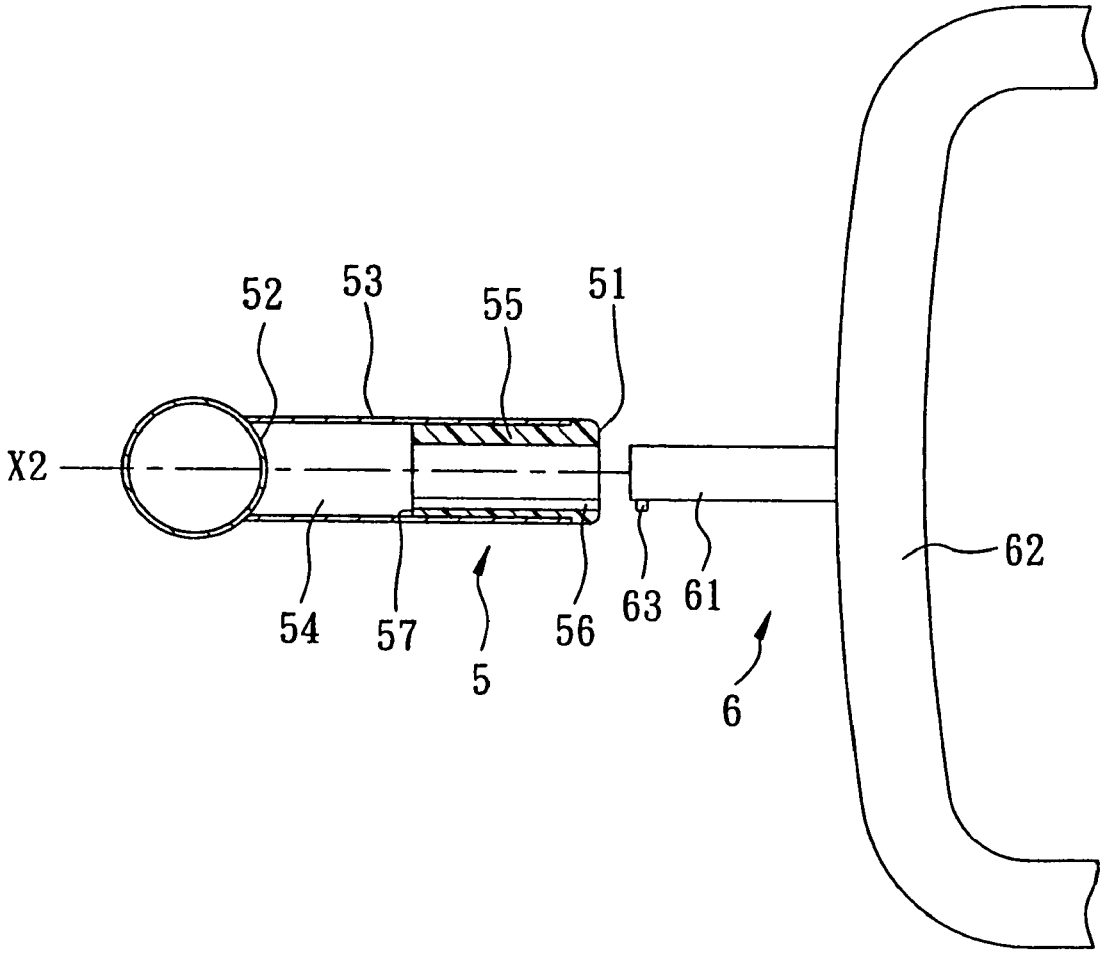
FIG. 9 is a partially sectional schematic view illustrating an engagement between a retainer device and a bracket device of a first preferred embodiment in accordance with the present invention.

Referring to FIGS. 3 to 9, a first musical instrument stand comprises a tripod device 2, a main shaft 3 disposed on the tripod device 2, a holder device 4 disposed on the main shaft 3, at least a retainer device 5, and at least a bracket device 6.

The retainer device 5 is disposed on the main shaft 3.

The bracket device 6 engages with the retainer device 5.

The tripod device 2 has a joint 22, and three legs 21 connected to the joint 22.

The main shaft 3 has a first tube 31 engaging with the joint 22, and a second tube 32 inserted through the first tube 31.

The holder device 4 has a main seat 41, a connector 42 connected to the main seat 41, a fixed fastening device 45, a movable fastening device 46, and the connector 42 engaging with the main shaft 3.

The main seat 41 has a generally U-shaped pad 47, an aperture 43 engaging with the fixed fastening device 45, and a socket portion 44 engaging with the movable fastening device 46.

The fixed fastening device 45 has a rod 451, a first hose 452, and a cap plug 453.

The rod 451 is inserted through the aperture 43 of the main seat 41.

The first hose 452 encloses the rod 451.

The cap plug 453 engages with the rod 451.

The movable fastening device 46 has a locking bar 462, a second hose 465, and a pillar 461 having an annular protrusion 464 and an end protrusion 463.

The pillar 461 is inserted through the second hose 465 and inserted in the socket portion 44 of the main seat 41.

The locking bar 462 engages with the pillar 461.

The locking bar 462 has a fastening end 466 having an end chamber 467 to receive the fixed fastening device 45.

The connector 42 has a top wall 421, a peripheral wall 422, a through hole 423 formed on the peripheral wall 422, an inner chamber 424 communicating with the through hole 423, and a confining portion 425 communicating with the inner chamber 424.

A nut 426 is inserted in the inner chamber 424 to match the through hole 423 of the connector 42. The nut 426 is blocked by the confining portion 425 of the connector 42.

A threaded button 7 is inserted through the through hole 423 of the connector 42 to be engaged with the nut 426.

The socket portion 44 of the main seat 41 has a first end 441, a second end 445, a first chamber 444, a second chamber 445 communicating with the first chamber 444, a periphery wall 443 surrounding the first chamber 444 and the second chamber 445, a confining groove 446 formed along a direction X1 to receive the end protrusion 463 of the pillar 461, and a confining block 447 disposed in the second chamber 445 to block the end protrusion 463 of the pillar 461.

A diameter of the first chamber 444 is smaller than a diameter of the second chamber 445.

The retainer device 5 has a pipe 53 and a hollow plug 55 engaging with the pipe 53.

The pipe 53 has a distal end 51, a proximal end 52, and a round hole 54 formed along a direction X2.

The hollow plug 55 has a click portion 57 and a confining recess 56 formed along the direction X2.

The bracket device 6 has a generally U-shaped frame 62 and a post 61 having an end block 63 to be inserted in the confining recess 56 of the hollow plug 55.

The post 61 is inserted in the hollow plug 55.

The first musical instrument stand holds a guitar.

Figure 10:
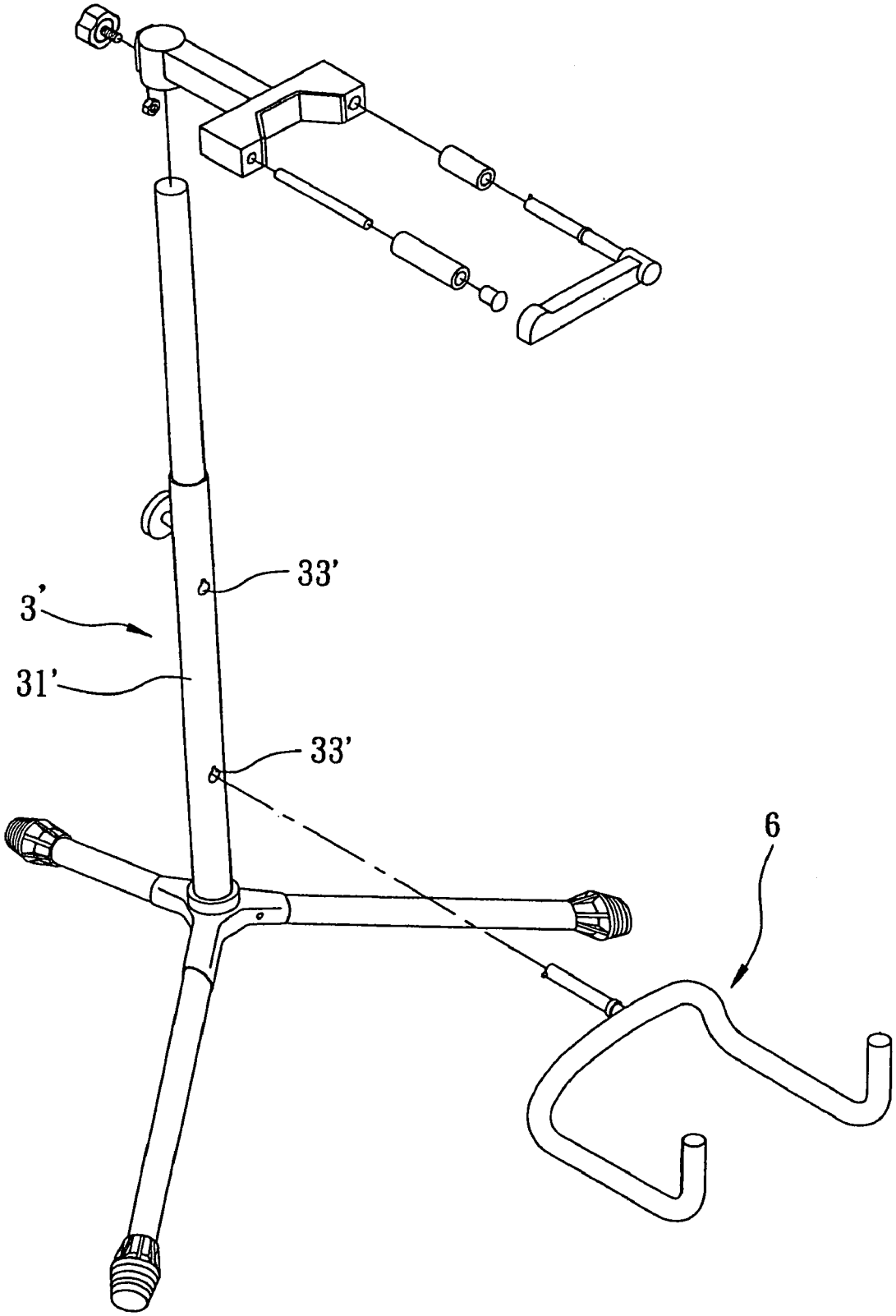
FIG. 10 is a perspective exploded view of a musical instrument stand of a second preferred embodiment in accordance with the present invention.

Referring to FIG. 10, a second musical instrument stand comprises a main shaft 3' having a tube 31'.

The tube 31' has a plurality of insertion holes 33'.

The bracket device 6 is inserted in one of the insertion holes 33' of the tube 31'.

The musical instrument stand of the present invention provides the socket portion to be engaged with the movable fastening device stably.

The present invention is not limited to the above embodiment but various modification thereof may be made. Furthermore, various changes in form and detail may be made without departing from the scope of the present invention.

What is claimed is:

1. A musical instrument stand comprising:

a tripod device, a main shaft disposed on the tripod device, a holder device disposed on the main shaft, at least a retainer device, and at least a bracket device, the retainer device disposed on the main shaft, a bracket device engaging with the retainer device, a tripod device having a joint, and three legs connected to the joint, the main shaft having a first tube engaging with the joint, and a second tube inserted through the first tube, the holder device having a main seat, a connector connected to the main seat, a fixed fastening device, a movable fastening device, and the connector engaging with the main shaft, and the main seat having a generally U-shaped pad, an aperture engaging with the fixed fastening device, and a socket portion engaging with the movable fastening device.

2. The musical instrument stand as claimed in claim 1, wherein the fixed fastening device has a rod, a first hose and a cap plug, the rod is inserted through the aperture of the main seat, the first hose encloses the rod, and the cap plug engages with the rod.

3. The musical instrument stand as claimed in claim 1, wherein the movable fastening device has a locking bar, a second hose and a pillar having an annular protrusion and an end protrusion, the pillar is inserted through the second hose and inserted in the socket portion of the main seat, and the locking bar engages with the pillar.

4. The musical instrument stand as claimed in claim 1, wherein the connector has a top wall, a peripheral wall, a through hole formed on the peripheral wall, an inner chamber communicating with the through hole, and a confining portion communicating with the inner chamber.

5. The musical instrument stand as claimed in claim 4, wherein a nut is inserted in the inner chamber to match the through hole of the connector, and a threaded button is inserted through the through hole of the connector to be engaged with the nut.

6. The musical instrument stand as claimed in claim 1, wherein the socket portion of the main seat has a first chamber, a second chamber 445 communicating with the first chamber, a periphery wall surrounding the first chamber and the second chamber, and a confining block disposed in the second chamber.

7. The musical instrument stand as claimed in claim 1, wherein the retainer Device has a pipe, a hollow plug engaging with the pipe, the pipe has a distal end, a proximal end, and a round hole, and the hollow plug has a confining recess.

* * * * *